US007561058B2

(12) United States Patent
Farley et al.

(10) Patent No.: US 7,561,058 B2
(45) Date of Patent: Jul. 14, 2009

(54) WARNING SYSTEM AND METHOD FOR ELECTRICAL DEVICES

(75) Inventors: David W. Farley, Orem, UT (US); Frank E. Liebmann, American Fork, UT (US); Allen E. Sjogren, Park City, UT (US)

(73) Assignee: Fluke Corporation, Everett, WA (US)

( * ) Notice: Subject to any disclaimer, the term of this patent is extended or adjusted under 35 U.S.C. 154(b) by 272 days.

(21) Appl. No.: 11/453,782

(22) Filed: Jun. 14, 2006

(65) Prior Publication Data

US 2007/0290871 A1 Dec. 20, 2007

(51) Int. Cl.
*G08B 21/00* (2006.01)

(52) U.S. Cl. ..... 340/635; 219/248; 320/166; 340/586; 340/589; 340/640; 374/1

(58) Field of Classification Search ..... 340/584–593, 340/635, 640, 679, 693.2; 73/1.01; 362/192; 219/248, 269, 445.1; 320/166; 374/1
See application file for complete search history.

(56) References Cited

U.S. PATENT DOCUMENTS 4,985,695 A * 1/1991 Wilkinson et al. ..... 340/568.3
6,399,919 B1 * 6/2002 Wu ..... 219/248
6,548,785 B1 * 4/2003 Rius et al. ..... 219/248
7,220,015 B2 * 5/2007 Dowling ..... 362/192
2006/0002218 A1 * 1/2006 Jain ..... 365/212

* cited by examiner

*Primary Examiner*—Brent Swarthout
(74) *Attorney, Agent, or Firm*—Dorsey & Whitney LLP

(57) ABSTRACT

An externally powered temperature calibration device includes a system that provides a warning of high temperatures within the device after the device has been disconnected from the external power. The warning system includes a capacitor that provides power to a light-emitting diode ("LED") after the calibration device has been disconnected from the external power. A temperature sensor monitors the temperature of an internal component. An output signal from the sensor is used to control a switch that connects the capacitor to one of several resistors having different resistances. The switch therefore controls the discharge rate of the capacitor based on the sensed temperature at the time the calibration device was disconnected from the external power. As a result, the period during which the capacitor powers the LED can be commensurate with the time required for the internal component to cool from its initial temperature.

18 Claims, 5 Drawing Sheets

WARNING SYSTEM AND METHOD FOR ELECTRICAL DEVICES

TECHNICAL FIELD

This invention relates to electrically powered devices, and, more particularly, to electrically powered devices with the potential to cause injury after electrical power has been disconnected from the device.

BACKGROUND OF THE INVENTION

A variety of electrically powered heating devices are in existence to provide a wide variety of functions. For example, electric stoves, frying pans and clothes irons are commonly used in homes. Soldering irons, temperature test chambers, and temperature calibration devices are commonly used in industry.

It is sometimes difficult to determine if an electrically heated surface is hot enough to cause injury. This is particularly true after the heated surface is no longer being heated. Such surfaces can remain very hot for a considerable period after heating power has been terminated. A variety of techniques have been developed to address this problem. One approach is to coat the heated surface with a material that changes color with temperature. While this is feasible in some cases, heated surfaces can sometimes be too large to make this approach practical. Also, temperature indicating materials cannot provide an indication of whether a heated surface that can be touched but not seen is too hot to touch. For example, this approach cannot provide an indication whether a heated surface inside a device is too hot to touch before one begins to disassemble the device.

Another approach to providing an indication that an electrically heated surface is too hot to touch is to use an electrical temperature sensor coupled to a warning light or the like. For example, electric stoves having a glass cooktop commonly include a warning light that is readily visible when the temperature of the cooktop is too hot to touch. This high temperature warning system can be very useful since, it is not readily apparent that the cooktop is at a high temperature after the underlying burner is no longer receiving electrical power. Furthermore, a temperature sensor and indicator can provide a warning that an internal surface, such as a cooking oven, is too hot. Also, this approach works well regardless of the temperature to which the surface was heated or the amount of time required for the surface to cool sufficiently that it is safe to touch. Unfortunately, the use of a temperature sensor and indicator is only practical if, after the surface is no longer being heated, electrical power continues to be applied to the device since the operation of the temperature sensor and indicator requires a continued supply of electrical power.

One class of electrically heated devices that presents a particular challenge to providing an indication of dangerous temperatures are temperature calibration devices or "dry well" calibrators which are used in calibrating temperature probes and sensors. Conventional dry well calibrators include removable inserts having bores therein that receive the temperature probes that are to be calibrated. These inserts are often changed with inserts of varying hole sizes to accommodate different temperature probe diameters. Heating elements thermally coupled to the insert heat the probes to a temperature that is set by a user. The insert and surfaces surrounding its opening as well as internal components of these dry well calibrators can become very hot while calibrating temperature probes at high temperatures. When a user is done with a probe calibration he might unplug the drywell calibrator from it's AC power source and leave it unattended while the calibrator is still very hot. A second user may remove the hot insert to set up the calibrator for another test, thereby causing an injury if touched. Unfortunately, if a dry well calibrator is disconnected from external power before the next user changes the insert for a different size, there is no warning to him of an unsafe temperature condition.

The above-described techniques for warning of excessive temperatures do not lend themselves well to warning of excessive temperatures of the internal components of dry well calibrators. The use of a temperature indication material is impractical because of the large amount of surface area that can be at a high temperature. Also, it would not be possible to see the temperature indicating material until the internal component or outer case was removed from the dry well calibrator, thereby potentially exposing the heated surfaces to inadvertent contact.

The other approach described above, i.e., using a temperature sensor and indicating light, would provide an indication that some internal surfaces are too hot to touch, but it would provide this indication only while the dry well calibrator was plugged into an AC power receptacle. Unfortunately, because of the relatively light weight and small size of conventional dry well calibrators, they are frequently unplugged and moved to different locations. For example, a dry well calibrator may be unplugged and moved from a calibration facility to a repair facility. Therefore, as a practical matter, the use of a temperature sensor and indicating lamp is not likely to be effective in providing adequate high temperature warnings.

Accidental burn injuries may also occur with other types of devices that are electrically heated by external power that may be disconnected from the devices. For example, clothes irons, curling irons, soldering irons and other similar devices can be inadvertently touched by users after they have been unplugged yet while they are still sufficiently hot to cause injury.

Similar safety problems can also exist with other types of electrically powered devices that can cause injury after power has been disconnected from the device. For example, hydraulic devices may include a pressure pump that raises the pressure of hydraulic fluid to a very high level. After power has been disconnected from the hydraulic device, the high pressure of the hydraulic fluid may remain present in the device. However, the presence of the high pressure may not be apparent, and injury may result if the pressure is inadvertently released.

There is therefore a need for a system and method that can provide an externally visible indication of dangerous internal temperatures and other unsafe conditions in electrically powered devices such as dry well calibrators even after external power has been removed from such devices.

SUMMARY OF THE INVENTION

A warning system and method for an electrical device powered by external electric power can warn of an unsafe condition even after the electrical device has been disconnected from the external electrical power source. A capacitor or other energy storage device within the electrical device stores electrical energy from the external electrical power. As a result, the energy storage device can provide electrical power after the electrical device has been disconnected from the external electrical power. A property that may result in the unsafe condition is monitored by a sensor and used to set a rate at which the stored electrical energy is depleted from the energy storage device. The electrical energy stored in the energy storage device is used to supply power to a warning device. The warning device therefore provides warning of the unsafe condition until the stored electrical energy has been depleted below a predetermined level. The energy storage device is therefore used as both a source of electrical power and a timing element to set the duration of the warning based on the nature of the sensed property when power was removed from the electrical device.

DETAILED DESCRIPTION

Embodiments of the present invention are directed to systems for warning of unsafe conditions in electrically powered devices that can cause injury after the devices have been disconnected from the electrical power. Certain details are set forth below to provide a sufficient understanding of the invention. However, it will be clear to one skilled in the art that the invention may be practiced without these particular details. In other instances, well-known circuits, control signals, and timing protocols have not been shown in detail in order to avoid unnecessarily obscuring the invention.

Figure 1:
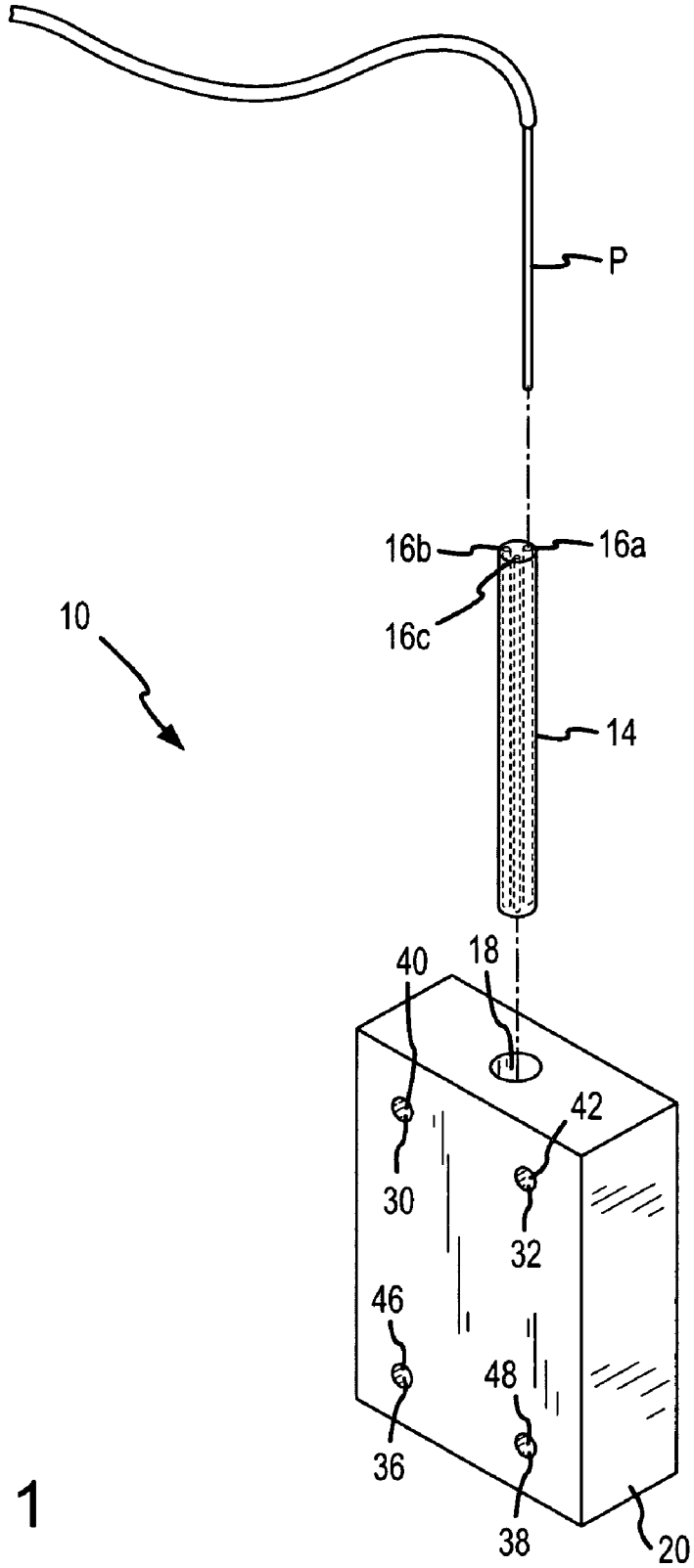
FIG. 1 is an exploded isometric view of some of the internal components of a temperature calibration device that includes a high temperature warning system according to various embodiments of the invention.

The internal components of a dry well calibrator heating block assembly 10 according to one example of the invention are shown in FIG. 1. The dry well calibrator 10 includes a cylindrical adapter insert 14 having one or more cylindrical bores 16*a,b,c* sized to receive temperature probes "P" having corresponding dimensions. The insert 14 is typically manufactured from a thermally conductive metal.

The insert 14 fits into a cylindrical bore 18 formed in a heated block 20 of a suitable material, such as a metal with good thermal conduction properties. The block 20 has a configuration that is rectangular in both vertical and horizontal cross-section, although, of course, it may also have a square, round or other configuration. The inside diameter of the bore 18 is only slightly larger than the outside diameter of the insert 14 to ensure good heat conduction from the block 20 to the insert 14.

Figure 2:
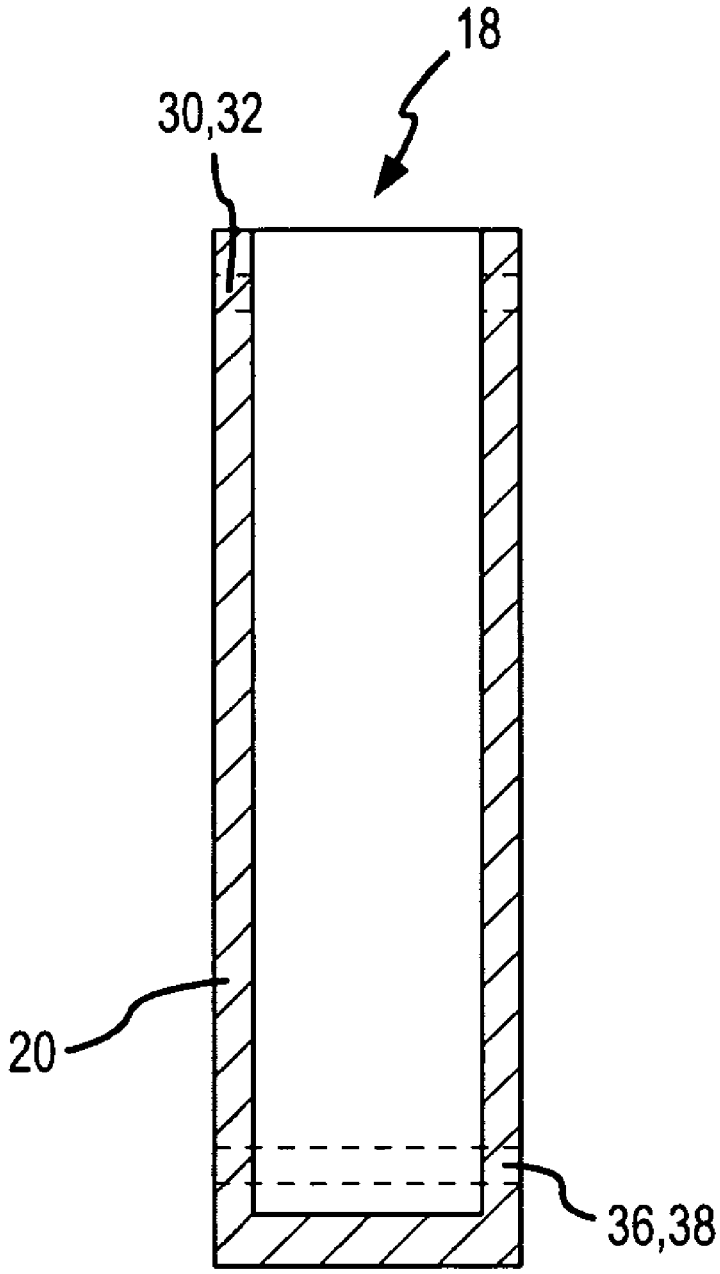
FIG. 2 is a cross-sectional view of the internal components of the temperature calibration device shown in FIG. 1.

With further reference to FIG. 2, a pair of upper heating elements 30, 32 and a pair of lower heating elements 36, 38 are placed in respective bores 40, 42, 46, 48 in the block 20.

Figure 3:
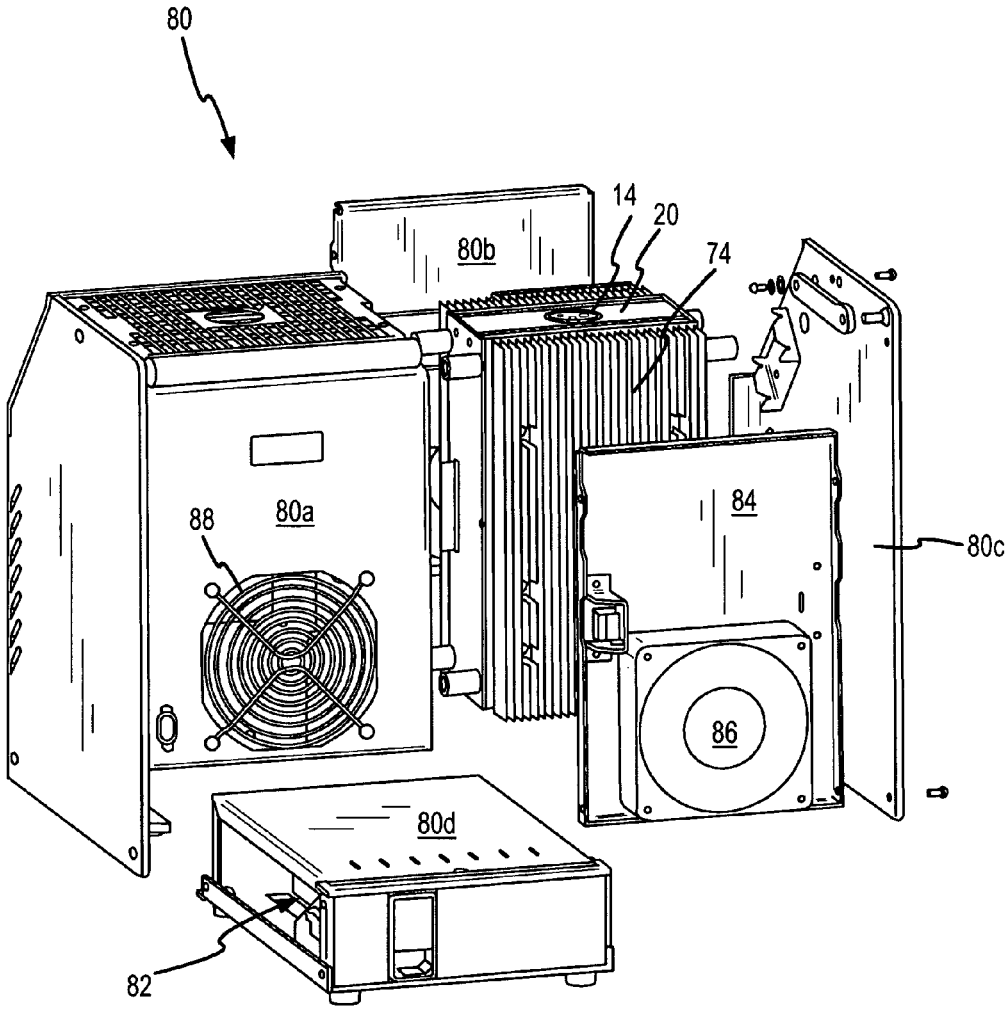
FIG. 3 is an exploded isometric view of the temperature calibration device shown in FIG. 1.

With reference also to FIG. 3, the above-described components of the dry well calibrator heating block 10 are surrounded by an outer case 80 formed by case sections 80*a,b,c,d*. The case section 80*d* contains circuitry 82 that is connected to the heating elements 30, 32, 36, 38 for supplying power to the heating elements 30, 32, 36, 38. A fan assembly 84 containing a fan 86 is positioned inside the case section 80*a* so that the fan 86 is behind a grill 88. The case 80 is separated from the block 20 by insulation (not shown) and an insulating space, and the fan 86 provides airflow through this insulating space to remove heat and maintain the circuitry 82 at a sufficiently low temperature.

Figure 4:
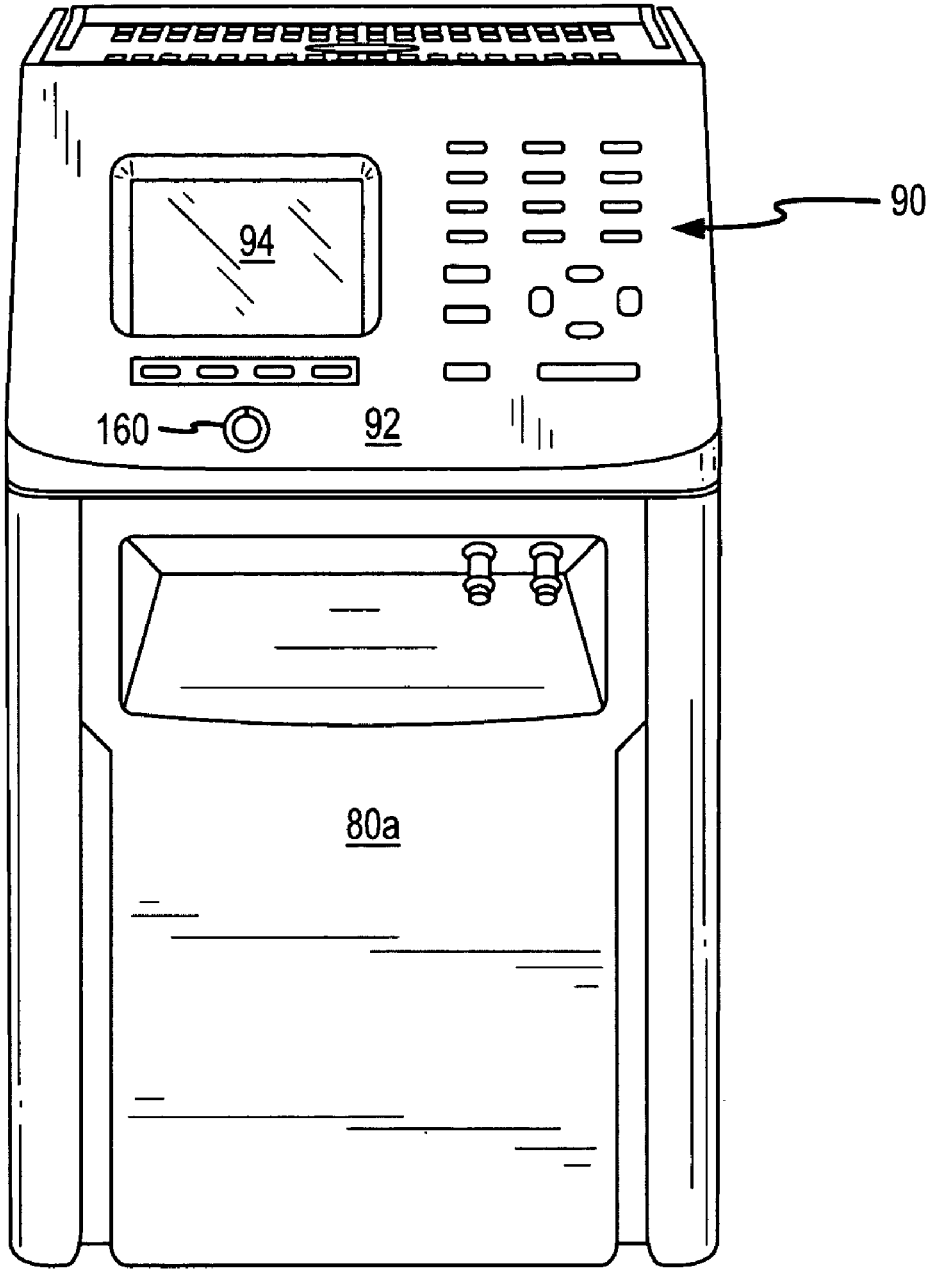
FIG. 4 is a front elevational view of the temperature calibration device of FIG. 1.

As best shown in FIG. 4, a keypad 90 mounted on a panel 92 of the case section 80*a* is connected to the circuitry 82 in the case section 80*d* (FIG. 3) to control the operation of the dry well calibrator heating block 10. A display 94, which is also connected to the circuitry 82 in the case section 80*d* (FIG. 3), provides information about the operation of the dry well calibrator 10, such as the temperature of the block 20.

In operation, the keypad 90 (FIG. 4) is used to set the temperature of the block 20 as well as the rate at which the temperature of the block 20 is changed to reach the desired set temperature. Once the temperature of the block 20 has stabilized, the temperature probe P (FIG. 1) is inserted into a corresponding sized bore 16 of the insert 14. The probe P is then calibrated by ensuring that a readout device (not shown) connected to the probe P indicates the temperature of the probe P is within an acceptable tolerance or equal to the set temperature of the dry well calibrator 10.

Figure 5:
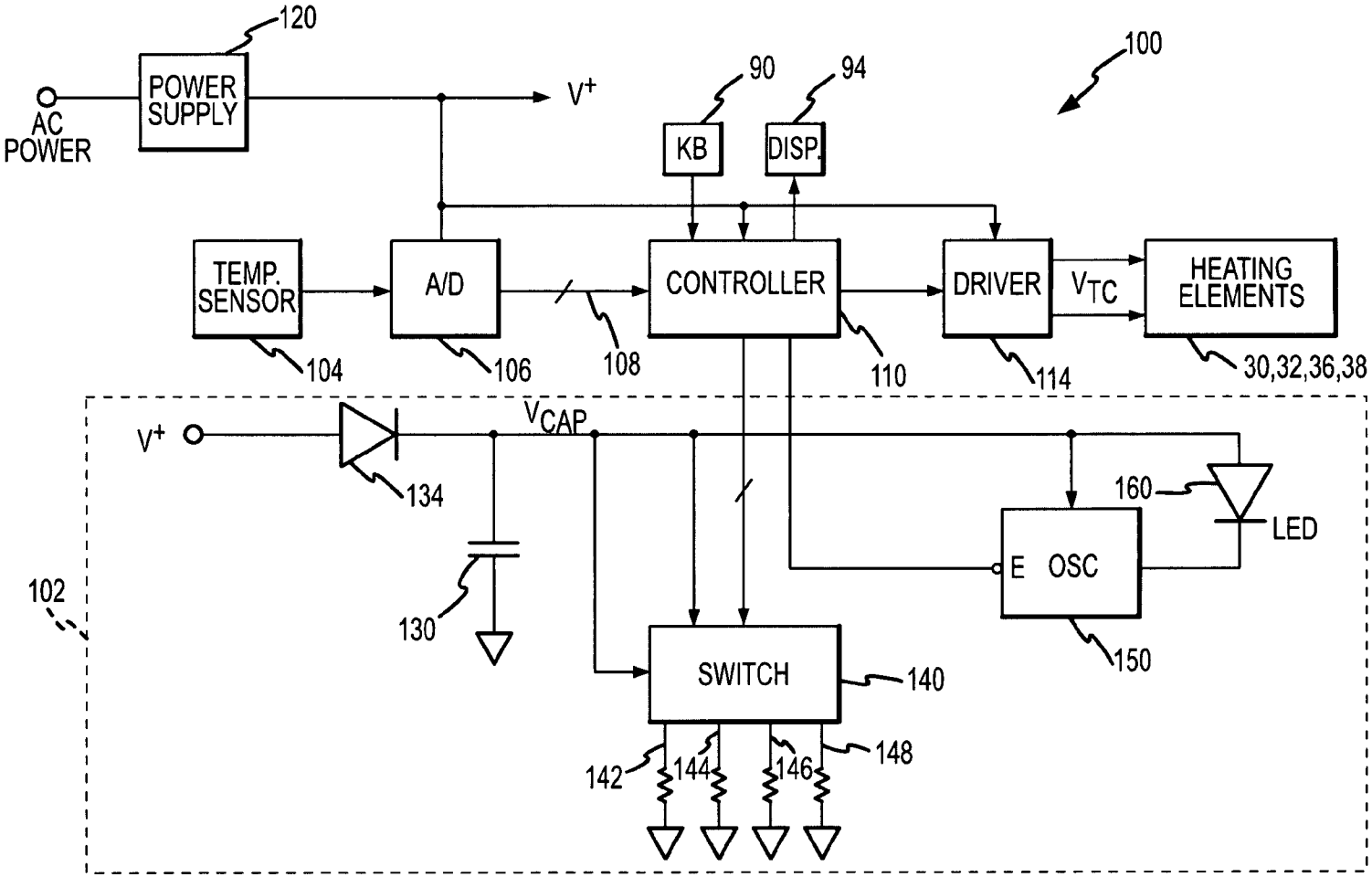
FIG. 5 is a block diagram showing one example of a control system for the temperature calibration device of FIGS. 1-4 that includes a high temperature warning system according to one example of the invention.

One embodiment of a system 100 for controlling the operation of the temperature calibration device 10 shown in FIGS. 1-4 is shown in FIG. 5. The system 100 also includes a system 102 for warning of an unsafe condition in the temperature calibration device 10. The control system 100 includes a temperature sensor 104 mounted on a surface to be monitored, such as the block 20 (FIGS. 1-3). The temperature sensor 104 provides an analog signal indicative of the temperature of the block 20. This analog signal is applied to an analog-to-digital ("A/D") converter 106, which outputs a plurality of bits on a bus 108 indicative of the temperature of the block 20. These bits are applied to a controller 110, which may be implemented by conventional means such as a properly programmed microprocessor. The controller 110 receives user commands from the keypad 90 (FIG. 4) and applies signals to the display 94 for providing information to the user, as explained above. The controller 110 also outputs a temperature control signal to a driver 114, which, in turn, outputs a temperature control voltage $V_{TC}$ to the heating elements 30, 32, 36, 38 (FIGS. 1 and 2). The above described components are powered by a supply voltage $V^+$, which is generated by a power supply 120 from an AC supply voltage.

In normal operation, the user enters commands through the keypad 90, thereby causing the controller 110 to apply the temperature control voltage $V_{TC}$ to the heating elements 30, 32, 36, 38 through the driver 114. During these keypad entries, the controller 110 can apply the appropriate signals to the display 94 to assist the user in operating the control system 100. The temperature of the block 20 will then increase or decrease depending on the polarity of the temperature control voltage $V_{TC}$. As the block 20 is heated, the temperature of the block 20 is monitored by the temperature sensor 104 to provide feedback to the controller 110. The controller 110 can then regulate the temperature control voltage $V_{TC}$ to ensure that the temperature of the block 20 reaches the temperature set by the user using the keypad 90. The control system 100 may also be capable of controlling the rate that the temperature of the block 20 increases or decreases to the set temperature as well as the rate that the temperature of the block 20 returns to an ambient temperature.

After the temperature calibration device 10 has been used to calibrate a temperature probe P (FIG. 1), it may be disconnected from the source of AC power. However, the temperature of the block 20 and other components internal to the calibration device 10 may remain at a high temperature for a substantial period. The duration of this period will, of course, vary with the temperature of the block 20 at the time power was removed from the device 10. However, the warning system 102 provides a warning to a user of this high temperature condition even after AC power has been removed from the system 100.

The warning system 102 includes a large capacitor 130 receiving the supply voltage $V^+$ from the power supply 120 through a diode 134. When the power supply 120 is disconnected from AC power, the diode 134 isolates the capacitor 130 from the power supply 120. However, the capacitor 130 continues to supply a voltage $V_{CAP}$ for a period that is determined by the capacitance of the capacitor 130 and the rate at which current is drawn from the capacitor 130.

The voltage $V_{CAP}$ from the capacitor 130 is applied to a switch 140 that is controlled by the controller 110. The controller 110 causes the switch 140 to couple the voltage $V_{CAP}$ to one of four resistors 142, 144, 146, 148. The resistance of the four resistors 142-148 are different from each other so that the capacitor 130 is discharged at different rates depending upon which resistor 142-148 is coupled to the capacitor 130 after the power supply 120 is no longer receiving AC power. The switch 140 is powered by the voltage $V_{CAP}$ so that it continues to couple the capacitor 130 to one of the resistors 142-148 after AC power has been removed from the power supply 120.

In operation, the discharge rate of the capacitor 130 is determined by the controller 110 during the operation of the system 100 when power is still being applied to the power supply 120. The discharge rate is set by the controller 110 as a function of the current temperature of the block 20. If the block 20 is very hot, the controller 110 may cause the switch 140 to couple the capacitor 130 to the resistor 148 having the highest resistance, thereby minimizing the discharge rate of the capacitor 130. If the temperature of the block 20 is below a predetermined temperature, the controller 110 may cause the switch 140 to couple the capacitor 130 to the resistor 142 having the lowest resistance, thereby maximizing the discharge rate of the capacitor 130. Intermediate temperatures of the block 20 cause the switch 140 to couple the capacitor 130 to one of the other resistors 144, 146.

The high temperature warning system 102 also includes an oscillator powered by the voltage $V_{CAP}$ from the capacitor 130. When the oscillator 150 is enabled by a low enables signal from the controller 110, it periodically drives a cathode of a light-emitting diode 160 low. The anode of the light-emitting diode also receives the voltage $V_{CAP}$ from the capacitor 130. Therefore, during normal operation of the system 100 when the oscillator 150 is enabled by the controller 110, the light-emitting diode 160 periodically emits light to warn a user that the block 20 and other internal components are too hot to touch. As shown in FIG. 4, this light-emitting diode 160 is mounted on the same panel 92 on which the keypad 90 and display 94 are mounted.

When the power supply 120 is disconnected from the source of AC power, the controller 110 no longer receives the supply voltage $V^+$ so that the controller 100 applies a low enables signal to the oscillator 150. Insofar as the oscillator 150 is still powered by the voltage $V_{CAP}$ from the capacitor 130, the oscillator 150 continues to periodically drive a cathode of the light-emitting diode 160 low. Also, since the anode of the light-emitting diode 160 is powered by the voltage $V_{CAP}$ from the capacitor 130, the light-emitting diode 160 continues to periodically emit light. The light-emitting diode 160 continues to periodically emit light as long as the voltage $V_{CAP}$ from the capacitor 130 is above a predetermined voltage. The duration of this period is, in turn, determined by the discharge rate of the capacitor 130. As explained above, the discharge rate is determined by the temperature of the block 20 when AC power was removed from the power supply 120. Therefore, the duration of the period during which the light-emitting diode 150 periodically emits light is determined by the temperature of the block 20 when the system 100 is disconnected from AC power. If the block 20 is very hot when AC power is removed from the system 100, the light-emitting diode 160 will continue to blink for a long period commensurate with the time required for the block 20 to cool to a sufficiently low temperature. If the temperature of the block 20 is below a predetermined temperature value when AC power is removed, the light-emitting diode 160 will blink for a much shorter period of time commensurate with the time required for the block 20 to cool to a sufficiently low temperature. Intermediate temperatures of the block 20 cause the light-emitting diode 160 to blink for periods of intermediate durations. Therefore, the capacitor 130 is used not only as an energy storage device to apply power to the light-emitting diode 160 when AC power has been removed from the system 100, but it is also used as a timing element to control the duration during which the light-emitting diode 160 is periodically illuminated.

While the warning system 102 according to the present invention has been described in the context of a system for warning of a high temperature in a specific temperature calibration device, it can be used to warn of other unsafe temperature conditions in other devices. The warning system 102 can also be used to provide a high temperature warning in devices such as soldering irons, clothes irons, curling irons, electric fry pans and other similar devices. The warning system can also be used to provide warnings of unsafe conditions other than high temperature. In such case, the temperature sensor 104 (FIG. 5) would be replaced by a sensor capable of monitoring the condition that may be unsafe. For example, in a system for warning of high hydraulic pressures, the sensor might be a pressure sensor. Other applications of the warning system 102 will be apparent to one skilled in the art.

Although the present invention has been described with reference to the disclosed embodiments, persons skilled in the art will recognize that changes may be made in form and detail without departing from the spirit and scope of the invention. For example, although the warning provided by the system described herein is a visual warning provided by the light-emitting diode 160, it will be understood that a different type of warning may be provided, such as an audible warning. Further, although the capacitor 130 is used to store energy from the externally applied AC power, it will be understood that other types of energy storage devices may be used in place of the capacitor 130. Such modifications are well within the skill of those ordinarily skilled in the art. Accordingly, the invention is not limited except as by the appended claims.

We claim:

1. In an electrical device powered by external electric power, a method of warning of an unsafe condition in the electrical device after the external electrical power has been removed from the electrical device, the method comprising:

within the electrical device, coupling the external electrical power to a capacitor and storing electrical energy in the capacitor so that electrical power can be provided within the electrical device after the external electrical power has been removed from the electrical device;

using the stored electrical energy to provide a perceptible warning so that the warning continues until the stored electrical energy has been depleted below a predetermined level;

sensing a property of the electrical device that results in the unsafe condition; and using the sensed property to adjust a magnitude of the current flowing from the capacitor to set a rate at which the stored electrical energy is depleted, wherein using the sensed property to adjust the magnitude of the current flowing from the capacitor comprises connecting the capacitor to at least one of a plurality of resistors having different resistances.

2. The method of claim 1 wherein the sensed property comprises the temperature of a component of the electrical device, and wherein the unsafe condition comprises an excessive temperature of the component of the electrical device.

3. The method of claim 2 wherein the act of using the sensed property to set a rate at which the stored electrical energy is depleted comprises:

increasing the rate at which the stored electrical energy is depleted responsive to an increase in the sensed temperature; and decreasing the rate at which the stored electrical energy is depleted responsive to a decrease in the sensed temperature.

4. The method of claim 1 wherein the sensed property comprises the temperature of an internal component of the electrical device.

5. The method of claim 1 wherein the act of using the stored electrical energy to provide a perceptible warning comprises using the stored electrical energy to provide a visual warning.

6. The method of claim 5 wherein the act of using the stored electrical energy to provide a visual warning comprises using the stored electrical energy to illuminate a warning light.

7. The method of claim 1 wherein the electrical device comprises a temperature calibration device.

8. A warning system for an externally powered electrical device, the warning system providing a warning of an unsafe condition in the electrical device after the external power has been removed from the electrical device, the warning system comprising:

an energy storage device coupled to receive the external power, the energy storage device being structured to store electrical energy received from the external power so that the energy storage device can supply electrical power after the external power has been removed from the electrical device;

a power consuming device coupled to the energy storage device, the power consuming device being structured to consume electrical power from the energy storage device at a rate determined by a power control signal; and a warning device coupled to the energy storage device, the warning device being structured to provide a perceptible warning until the electrical energy stored in the energy storage device has been depleted below a predetermined level, the warning device further comprising a sensor structured to sense a property of the electrical device that may result in the unsafe condition and to provide a sensor signal that is indicative of the sensed property, the warning device further comprising a controller coupled to the sensor and the power consuming device, the controller being structured to generate the power control signal as a function of the sensor signal so that the rate at which the power consuming device consumes electrical power from the energy storage device is determined by the sensed property.

9. The warning system of claim 8 wherein the sensor comprises a temperature sensor in thermal communication with a component of the electrical device, and wherein the unsafe condition comprises an excessive temperature of the component of the electrical device.

10. The warning system of claim 9 wherein the controller is operable to apply the power control signal to the power consuming device to cause the power consuming device to consume electrical power from the energy storage device at an increased rate responsive to an increase in the sensed temperature, and to cause the power consuming device to consume electrical power from the energy storage device at a decreased rate responsive to a decrease in the sensed temperature.

11. The warning system of claim 8 wherein the component of the electrical device with which the temperature sensor is in thermal communication comprises an internal component of the electrical device.

12. The warning system of claim 8 wherein the energy storage device comprises a capacitor.

13. The warning system of claim 12 wherein the power consuming device is structured to adjust the magnitude of current flowing from the capacitor responsive to the power control signal.

14. The warning system of claim 13 wherein the power consuming device comprises:

a plurality of resistors having different values of resistance; and a switch having a first terminal connected to the capacitor and a plurality of second terminals coupled to respective ones of the resistors, the switch having a control terminal coupled to receive the power control signal from the controller, the switch being structured to connect the first terminal to one of the second terminals selected by the power control signal.

15. The warning system of claim 14 wherein the switch further comprises a supply voltage tenninal that is coupled to receive power from the capacitor.

16. The warning system of claim 8 wherein the warning device comprises a visible warning device coupled to receive power from the capacitor.

17. The warning system of claim 16 wherein the visible warning device comprises a light-emitting diode.

18. The warning system of claim 8 wherein the electrical device comprises a temperature calibration device.

* * * * *

UNITED STATES PATENT AND TRADEMARK OFFICE

CERTIFICATE OF CORRECTION

PATENT NO. : 7,561,058 B2
APPLICATION NO. : 11/453782
DATED : July 14, 2009
INVENTOR(S) : David W. Farley et al.

It is certified that error appears in the above-identified patent and that said Letters Patent is hereby corrected as shown below:

| Column, Line | Reads | Should Read |
|---|---|---|
| Column 6, Line 2 | "emitting diode 150" | --emitting diode 160-- |

Signed and Sealed this

Tenth Day of November, 2009

David J. Kappos

David J. Kappos
*Director of the United States Patent and Trademark Office*